United States Patent [19]

de Vries

[11] 4,394,959

[45] Jul. 26, 1983

[54] MULTIMODE HEATING SYSTEM AND METHOD FOR HEATING

[75] Inventor: Auke O. T. de Vries, Leek, Netherlands

[73] Assignee: N.V. Nederlandse Gasunie, Groningen, Netherlands

[21] Appl. No.: 213,486

[22] Filed: Dec. 5, 1980

Related U.S. Application Data

[63] Continuation of Ser. No. 955,609, Oct. 30, 1978, abandoned.

[30] Foreign Application Priority Data

Oct. 28, 1977 [DE] Fed. Rep. of Germany ..... 2748415

[51] Int. Cl.[3] ..... G05D 23/00; F25B 27/02

[52] U.S. Cl. ..... 237/2 B; 62/238.3; 62/324.2; 165/62; 237/80

[58] Field of Search ..... 62/238.3, 324.2; 237/2 B; 165/2, 16, 194, 1, 62

[56] References Cited

U.S. PATENT DOCUMENTS

| | | | |
|---|---|---|---|
| 2,272,871 | 2/1942 | McGratti | 165/16 |
| 3,177,930 | 4/1965 | Anderson | 165/62 |
| 3,556,200 | 1/1971 | Leonard | 165/2 |
| 3,605,873 | 9/1971 | Leonard | 165/2 |
| 3,626,716 | 12/1971 | Leonard | 62/194 |
| 4,079,778 | 3/1978 | Trump | 165/1 |

*Primary Examiner*—Albert J. Makay
*Assistant Examiner*—Henry Bennett

[57] ABSTRACT

An improved multimode heat-pump type heating system designed to heat a plurality of rooms efficiently under a variety of ambient temperature conditions. When in its first mode the heat pump system employs an operating fluid, such as ammonia, and an absorbing liquid, such as water. The ammonia is initially evaporated in a cold heat source so as to absorb or extract heat therefrom. It is then absorbed by the absorbing liquid and both transported to a boiler where the two are again separated. The absorbing liquid returns to the absorbing area while the operating fluid flows to a condenser and condensed after which it is returned directly to the evaporator. A plurality of heat exchangers are used to transfer heat from the operating fluid, the absorbing liquid or the system to a room heating fluid. In the second mode, the evaporator and absorbing portions of the system are bypassed and only the operating fluid circulates from the condenser to the boiler past heat exchangers in order to heat the operating fluid. The system switches to the second mode when ambient temperatures fall below a preselected temperature or when pressure in the evaporator drops below a predetermined level.

25 Claims, 1 Drawing Figure

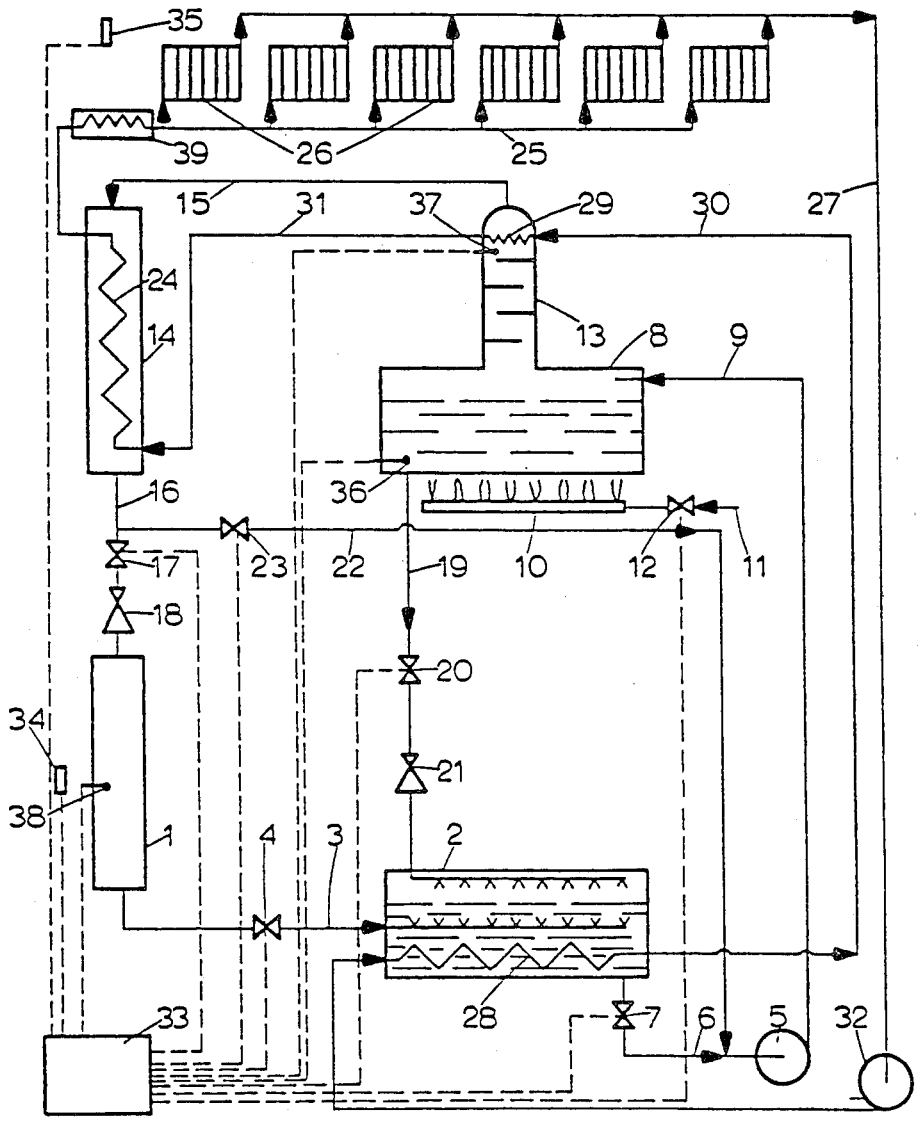
35
39
26
25
15
31
37
29
30
27
24
14
13
8
9
16
36
10
12
11
17
23
22
19
18
20
34
21
38
1
4
3
2
28
7
6
5
32
33

MULTIMODE HEATING SYSTEM AND METHOD FOR HEATING

This application is a continuation of Ser. No. 955,609 filed Oct. 30, 1978 now abandoned.

The present invention relates to a heating system equipped with at least one heat pump for absorbing heat from its surroundings or the area to which it is exposed, preferably the outside atmosphere. The extracted heat can then be delivered directly via one or more heat exchangers to heat one or more rooms. Provision is also made for providing heat when exterior ambient temperatures become too cold thereby providing the system with more than one operating mode.

Systems based on heat pumps offer good prospects for the saving of primary energy especially when considering room heating. Such a system is known and described in NL-AS No. 7500642. This known system operates with a dual mode with the first mode operating at ambient air temperature conditions which are not too low. The operating portion of the system is a first compressing heat pump called a "basic heat pump". This known system also includes a second operating mode which operates at extremely low ambient air temperature conditions during which mode a second compressing or auxiliary heat pump is connected to the "basic heat pump". An operating range is achieved which is wider in view of variations of the ambient air temperature and in view of the load of the system than with a simpler pump system which has only one operating mode. This is due to the limitations which exist because of the fact that the ratio of compression of the compressor and the temperature of the pressure line should not be too high whereas the evaporation temperature should not be too low.

Such a complex and maintenance-requiring system is economically attractive only for large plants and the sound level of the motors and compressors employed can be very bothering. Further, in small plants an electrically driven compressor would very likely be used which makes the ratio of primary energy used compared to the energy used in conventional heating systems unfavorable.

It is therefore an object of the present invention to provide for a simpler and also, considering especially small plants, an economically attractive, easily maintainable, low-noise heating system. Such a system will have at least one heat pump which can absorb heat from the surrounding area and apply such heat directly or via one or more heat exchangers to one or more rooms being heated. Accordingly, the system has more than one operating mode. The cold heat source can be ambient air or for that matter a source of, for example, open water, ground water, the earth or industrial waste water, etc.

To achieve this object the preferred exemplary embodiment of the heating system according to the present invention is provided with first means which may be used in a first operating mode as an absorption-heat-pump and with at least one heat source for provision of the driving power. The system also includes second means substantially equivalent to the first means but which operates in a second operating mode as an evaporating or condensing system for supplying heat directly or via one or more heat exchangers from the heat source to the room or rooms being heated.

As a heat source for providing the driving power a heating station can be used that is heated by fossil fuel, preferably by a gaseous fuel, but it can also use, for example, a vapor helix. A heating station heated by gas has the advantage of providing efficient and economical energy distribution.

It the ambient temperature is not too low, or above a predetermined minimum condition, the heating system operates in the first operating mode. However, when ambient temperatures are lower than these minimums the system will operate in the second operating mode.

References herein to an "evaporating-condensing-system" means a closed system in which a liquid may evaporate in the area of a heat source by absorbing heat whereby such vapor may condense at another location of the system under desorption of heat. The condensed liquid flows back to the heating station and if necessary such flow can be forced by a circulating pump.

As is well known, an absorption heat pump comprises an evaporator followed by an absorbing container, a liquid pump, a boiling receptacle and a condenser which are arranged in their respective order in the flow direction of the operating medium. In the evaporator, the operating medium evaporates at low pressures and extracts heat from the surrounding area as it is preferably located in the cold heat source and can absorb heat from its surrounding environment. The gaseous medium then flows to the absorbing container where it is absorbed in an absorption liquid. The liquid pump moves the liquid enriched with the operating medium to the boiling receptacle which is heated thereby driving the operating medium, again as a gas, out of the liquid. The gas passes into the condenser where the operating medium is condensed at higher pressures thereby emitting heat. A throttle valve is provided in the return line leading from the condenser to the evaporator. Further, a return line containing a throttle valve for carrying the absorption liquid depleted of operating medium leads from the boiling receptacle to the absorbing container.

The invention will now be explained in connection with the drawing and an example.

The drawing shows the heating system according to the present invention schematically which should by no means be limited to the shown scheme.

The heating system according to the present invention preferably is a circulating system comprising in their respective order an evaporator 1, connected to an absorbing container 2 by line 3 having a shut-off valve 4 located therein. A liquid pump 5 is connected via line 6 and a shut-off valve 7 to the absorbing container 2 and in turn, via line 9 to a boiling receptacle 8 heated by a gas burner element 10 supplied with gas via line 11 and valve 12. The boiling receptacle 8 includes a separating column 13 located in its upper portion with column 13 connected to a condenser 14 by connecting line 15. Condenser 14 itself is connected by a first connecting line 16, shut-off valve 17 and a throttle valve 18 to the evaporator 1. The circulating system also includes a return line 19 containing a shut-off valve 20 and a second throttle valve 21 extending between the boiling receptacle 8 and the absorbing container 2. These parts together form an absorption-heat-pump for the first operating mode.

The second operating mode of the absorbing container is so large that the whole supply of absorption liquid can be stored therein and additionally shut-off valves are provided to shut off that part of the system which is formed of the evaporator and to the absorbing container. A second connecting line 22 containing a shut-off valve 23 is provided between the outlet of the condenser 14 and the inlet of the liquid pump 5. If desired a heat exchanger may be provided in the system between the relatively cold liquid pumped to the boiling receptacle and the relatively warm liquid flowing through the return line out of the boiling receptacle to achieve internal heat exchange (not shown).

In the second operating mode the operating medium is evaporated in the boiling receptacle 8 and condensed in condenser 14. The absorbing liquid is stored in the absorbing container 2.

The invention also relates to a method for heating of buildings by means of the heating system according to the invention whereby at least one heat pump is used which can absorb heat from the surrounding area and supply heat directly or via one or more heat exchangers shown at 24, 28, 29 and 39 to one or more rooms to be heated by radiators 26. Water is preferably circulated by a pump 32 through the absorbing chamber, then line 30, heat exchanger 29 in separating column 13. From there line 31 leads through condenser heat exchanger 24, flue gas heat exchanger 39 and is returned to pump 23 from radiators 26 via line 27.

The method according to the present invention is characterized in that an operating medium is evaporated continuously in the first operating mode within an evaporator whenever ambient temperatures are above a predetermined threshold value, whereby the evaporating operating medium extracts or absorbs heat from its surrounding area. Thereafter the evaporated operating medium is absorbed by an absorption liquid contained in the absorbing container and the absorbing liquid is pumped continuously to a boiling receptacle together with the operating medium by means of a pump 5. In the boiling receptacle 8 the absorption liquid is heated driving the operating medium out of the absorbing liquid. Then the operating medium condenses in the condenser 14 at higher pressure simultaneously emitting heat which is supplied directly or via one or more heat exchangers to heat one or more rooms. The condensed operating medium will be returned via a throttle valve 18 to the evaporator whereas the absorption liquid depleted of operating medium will be returned via a throttle valve to the absorbing container.

If the ambient temperature falls below the preselected threshold value the absorption liquid will be stored in a second operating mode whereby the connections between condenser and evaporator, absorbing container and pump as well as boiling receptacle and absorbing container are shut off while the condenser will be connected to the pump and the condensed operating medium will be pumped to the boiling receptacle.

Then the operating medium evaporates in a circulating system within the boiling receptacle and condenses again in the condenser whereby heat is transported from the heated boiling receptacle to the condenser. Water is used preferably as the absorbing liquid and ammonia is preferred as the operating medium. The absorption liquid is preferably stored during the second operating mode in the absorbing container.

When carrying out the method according to the invention in the first operating mode ice may be deposited on the evaporator thereby lowering the pressure within the evaporator. The method according to the invention then will be carried out preferably in such a way that it is temporarily carried out in the so-called second operating mode if the ambient temperature is higher than the selected threshold value and if ice depositions on the evaporator occur resulting in pressure reducement within the evaporator. Further, the absorption liquid stored in the absorbing container will then be evaporated and condensed in the condenser emitting heat which melts the ice deposited on the evaporator. As soon as the pressure rises within the evaporator due to the removal of ice depositions the method will once again be carried out in the first operating mode.

The heating system as shown operates as follows: If the ambient temperature is not too low the system operates in the first operating mode and thereby functions as a heat pump. Upon actuation from the control device 33 the shut-off valves 4, 7, 17 and 20 are open while shut-off valve 23 is closed. The gas burner 10 is controlled by the gas shut-off valve 12 in such a way that the temperature measured by temperature sensor 35 corresponds to the desired preselected value. The operating medium will be evaporated in evaporator 1 whereby heat is absorbed from the surrounding area. The operating medium is absorbed by the absorption liquid in the absorbing container 2 and the operating medium will be driven out of the absorbing liquid inside the boiling receptacle 8 when the latter is heated. The evaporated absorbing liquid will be separated inside the separating column 13 and the operating medium condenses in the condenser 14 thereby emitting heat to the heat exchanger 24 and returns via line 16, shut-off valve 17 and throttle valve 18 to condenser 1. The absorption liquid flows from the absorbing container 2 through connecting line 6, pump 5 and connecting line 9 to boiling receptacle 8. A liquid return line 19 connects receptacle 8 and the absorbing container 2 as controlled by valves 20 and 21.

According to the present example, water flows through the heat exchanger 24 where it is heated and then through the flue-gas heat exchanger 39 where it absorbs still more heat from combustion gases. The heated water then flows via the hot water line 25 to the heating radiators 26 while the cooled down water returns through return line 27 to pump 32 and will then be heated again in the heat exchangers 28, 29 and 24. The gas volume supplied to gas burner 10 will be controlled by the control device 33 in such a way that the temperature sensed by the sensor 34 will be kept on a preselected nominal value. As indicated above, a further heat exchanger can be connected for the purpose that liquid flowing in the liquid return line 19 transfers a part of its heat to liquid flowing in connecting line 19 so that the latter will be heated to some extent.

The second operating mode, which is the evaporating-condensing-system is also operated in two modes: Initially, this mode can be operated intermittently for a short period of time, with longer periods inbetween during which the heat-pump-mode will be applied. That mode occurs at ambient temperature that is lower to some extent. However, during this mode ice will frequently be deposited on the outside of the evaporator 1 which hampers heat transfer. When this occurs the temperatures and pressures in the evaporator 1 are reduced and these changes are monitored by pressure sensor 38. Therefore, evaporator 1 must be defrosted at regular intervals. Of course the heating of the building must not be interrupted thereby so the system is then operated. temporarily according to the second operating mode.

If ambient temperatures fall below a preselected value so that the heat pump system cannot extract a sufficient amount of heat from the surrounding area and if the frequent defrosting of the evaporator would require such an amount of energy that the efficiency of the system that is based on heat pumps would deteriorate compared to evaporating-condensating-systems the second mode is actuated.

Switching from the first to the second operating mode is done as follows: (a) shut-off valves 17 will be closed. Operating medium still present in the evaporator 1 flows through connecting line 3 into the absorbing container 2 where it will be absorbed by the absorption liquid; (b) the operating medium will be removed from the absorption liquid as it circulates between the absorbing container 2 and the boiling receptacle 8, and condensed in the condenser 14 where it will be temporarily stored; (c) after the operating medium is substantially removed, the absorption liquid evaporates due to the heating in receptacle 8 and the pressure sensed by the pressure sensor 37, located in the separating column 13, increases. Then, shut-off valve 7 will be closed so that liquid supplied to the boiling receptacle 8 will be disconnected and the receptacle empties into the absorbing container 2; (d) when the level sensor 36 indicates that boiling receptacle 8 is practically emptied, shut-off valve 12 will be closed so that gas burner 10 is switched off. When the boiling receptacle 8 is emptied shut-off valve 20 will be closed; (e) shut-off valve 23 will be opened. Operating medium condensed in the condenser 14 will flow to pump 5 and then to the boiling receptacle 8; (f) the gas burner 10 will be actuated by opening of the shut-off valve 12 in response to the change of the level of liquid therein sensed by sensor 36. Operating medium again evaporates within the boiling receptacle 8 and condenses within the condenser 14 and heat generated thereby can be transferred to the water flowing through the heat exchanger 24. Now, the system is in the second operating mode and works as an evaporating-condensating-system.

Whether the shut-off valve 4 will be opened or closed during the second operating mode depends on ambient temperatures. If the ambient temperature is higher than the solidification point of the absorption liquid, not under 0° C. or as a safety measure higher than 1°-2° C., then the shut-off valve 4 will be open; absorption liquid evaporates within the absorbing container 2, condenses within the evaporator 1 emitting heat so that ice deposited on evaporator 1 melts and flows back to the absorbing container 2 as a liquid. If the ambient temperature is lower than 0° C., the shut-off valve 4 will be closed.

The switch over from the second to the first operating mode is simply effected by opening the shut-off valves 4, 7, 17 and 20 and by closing off the shut-off valve 23.

EXAMPLE

When using a heating system according to the present outline, ammonia is used as operating medium and water is used as the absorption liquid. At ambient temperatures, which are not under 1° to 2° C., the system is operated in the first operating mode as a heat pump with the following conditions.

Temperature in condenser: ca. 50° C.
Temperature in evaporator: ca. 3° C.
Energy absorbed from the surrounding per joule of effective heating energy: 0.49 joule
Heating efficiency of the station: 0.85
Total heating efficiency $=(0.49\times0.85)+0.85=1.26$
Savings over conventional central heating systems with a heating efficiency of 0.75: $(1.26-0.75)/1.26\times100\%=$ca.40%

For ambient temperatures lower than 1° to 2° C., the system is operated in the second operating mode as an evaporating-condensating-system.

Assuming that the heating of a well isolating medium size house requires approximately 11 kW at an ambient temperature of −10° C., a maximum ammonia circulation of 11/1050=ca. 0.01 kg/s will be calculated considering a heat transport of 1050 kJ for each kilogram of ammonia condensing within the condenser. Considering a heating efficiency of 85% the gas burner must have a power of 11/0.85=ca. 13 kW.

The example describes the heating system according to the invention by referring to a hot water-central heating. However, it is obvious that the invention may be carried out in a different way, for example, as hot air-heating system.

While the invention has been described in connection with what is presently conceived to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures and methods.

What I claim is:

1. A multimode heating system for heating one or more rooms comprising first circulation means for circulating a heating fluid to treat the environment in the rooms, second circulation means for circulating an operating fluid and an absorbing liquid through a heat absorption path, said second circulation means including primary heat pump means through which the operating fluid and absorbing liquid are circulated for absorbing heat from cold and hot heat sources, means for transferring heat within said second circulation means to the heating fluid within said first circulation means by one or more heat exchangers, and control means for controlling changes in the operation of the multimode heating system between first and second operating modes in response to exterior temperature conditions so that when exterior temperatures are above a predetermined point, the system operates in a first mode wherein The operating fluid is circulated through said cold heat source and subsequently mixed with said absorbing liquid for circulation through said hot heat source and when exterior temperatures fall below said predetermined point, said control means changes the system to the second operating mode wherein the flow of the operating fluid bypasses said cold heat source and said absorbing liquid and passes directly as a liquid from said transfer means to said hot heat source to be evaporated there with substantially only the operating fluid being circulated and used to heat the heating fluid in said first circulation means.

2. A multimode heating system as in claim 1 wherein said primary heat pump includes evaporator means for evaporating the operating fluid, absorbing means for receiving both the evaporated operating fluid and the absorbing liquid, so that the latter can absorb the former; boiler means for receiving the absorbing liquid and the absorbed operating fluid and for separating the operating fluid from the absorbing liquid, said boiler means further including conduit means for providing a connection to said absorbing means so that the absorbing liquid can return to said absorbing means following separation from the operating fluid, means for moving the absorbing liquid between said absorbing means and said boiler means; and condensing means connected to said boiler means for receiving and condensing said separated operating fluid.

3. A multimode heating system as in claim 2 wherein said boiler means includes a separating column for collecting the separated operating fluid.

4. A multimode heating system as in claim 2 wherein said absorbing means includes at least one heat exchanger through which the heating fluid flows.

5. A multimode heating system as in claim 2 wherein said condensing means includes at least one heat exchanger through which the heating fluid flows.

6. A multimode heating system as in claim 3 wherein said separating column includes at least one heat exchanger through which the heating fluid flows.

7. A multimode heating system as in claim 2 wherein said boiler means further includes a burner means for supplying heat and a combustion gas flue to discharge combustion gases.

8. A multimode heating system as in claim 7 wherein said flue includes at least one heat exchanger through which the heating fluid flows.

9. A heating system for heating of one or more rooms or buildings equipped with radiators and heating fluid lines comprising:

means for evaporating an operating fluid and simultaneously absorbing heat from its surrounding environment;

means for absorbing the heat-containing operating fluid in an absorption liquid;

means for boiling the absorption liquid enriched with operating fluid and for separating the operating fluid from said absorption liquid;

means for transporting the absorption liquid from said absorbing means to said boiling means and back;

means for condensing the operating fluid so that heat therein is transferred to the heating fluid lines;

first return means for returning the operating fluid from the condensing means to the evaporating means during a first operating mode;

second return means for returning substantially only the operating fluid during a second operating mode from the condensing means directly to the boiling means; and control means for controlling the operation of the system in response to exterior temperature conditions and for switching the system from the first to the second operating mode.

10. A system according to claim 9 wherein the first and second return means each comprise a connecting line having at least one shut-off valve therein, said shut-off valve in said second return means closing the connecting line to the boiling means during the first operating mode and the shut-off valve in said first return means closing the connecting line to the evaporating means during the second operating mode.

11. A system according to claim 10 wherein the control means further includes switching means for actuating said shut-off valves in response to receiving temperature and pressure signals from an ambient temperature sensor and from a pressure sensor located inside the evaporating means.

12. A system according to claim 11 wherein a connecting line is provided between the boiling means and the absorbing means, said connecting line containing a shut-off valve controlled by said switching means.

13. A system according to claim 10 wherein said first return means also includes first throttle valve means for varying the flow rate between the condensing means and the evaporating means.

14. A system according to claim 9 wherein said absorption liquid transport means includes second throttle means for varying the flow rate between the boiling means and the absorbing means.

15. A multimode method for heating one or more rooms or buildings equipped with radiators and heating fluid supply lines, including the steps of:

monitoring ambient temperatures and pressure conditions within the evaporator portion of the system, operating the system in a first mode when exterior temperatures are above a preselected temperature, the first mode including the steps of:

evaporating a suitable operating fluid inside an evaporating means thereby taking up heat from its surrounding environment;

absorbing the operating fluid in an absorption liquid contained in an absorbing means;

transporting the absorption liquid together with the operating fluid to a boiling means and separating the operating fluid from the absorption liquid by application of heat;

condensing the separated operating fluid in a condensing means through which a heating fluid is passed thereby transferring heat to the heating fluid; and returning the operating fluid to the evaporating means; and switching to a second mode when exterior temperatures fall below the preselected temperature or when evaporating pressure falls below a preselected level, the second operating mode including steps of:

storing the absorption liquid; and directly feeding substantially only the operating fluid discharged from the condensing means to the boiling means so that the operating fluid is vaporized thereby bypassing the evaporating means and the absorbing means; and after vaporizing the operating fluid condensing the operating fluid in the condensing means so that more heat is transferred to the heating fluid.

16. The method according to claim 15 wherein ammonia is used as the operating fluid and water is used as the absorption liquid.

17. The method according to claim 15 wherein during the second operating mode all the absorption liquid is stored in the absorbing means.

18. Method for the heating of buildings by use of at least one heat pump which can absorb means from its surroundings and supply heat to one or more rooms to be heated characterized in that an operating medium is continuously evaporated within an evaporator at lower pressure in the first operating mode when the ambient temperature exceeds a certain predetermined threshold value whereby the evaporating operating medium absorbs heat from its surroundings, absorbing the now evaporated operating medium by an absorption liquid contained in an absorbing container, continuously pumping the absorption liquid together with the absorbed operating medium to a boiling receptacle wherein it is heated and the operating medium thereby is driven out of the absorption liquid; condensing the driven out operating medium within a condenser at higher pressure thereby emitting heat which will be supplied to one or more rooms to be heated; returning the condensed operating medium through a throttle valve to the evaporator and separately returning the absorption liquid now depleted of operating medium to the absorbing container; and storing the absorption liquid during a second operating mode if the ambient temperature falls below the predetermined threshold value thereby closing the connection from the condenser to the evaporator and shutting off the connection between boiling receptacle and absorbing container with connecting the outlet of the condenser to the pump and pumping condensed operating medium back to the boiling receptacle with the operating medium thereafter being evaporated within the boiling receptacle and being condensed within the condenser in a circulating manner whereby heat is transported from the heated boiling receptacle to the condenser.

19. Method according to claim 18 characterized in that the absorption liquid is stored in the second operating mode inside the absorption container.

20. Method according to claim 18 further including the steps of monitoring the pressure within the evaporator so that heating is temporarily carried out in the second operating mode even if the ambient temperature is higher than the predetermined threshold value when a pressure drop occurs in the evaporator due to ice depositions on said evaporator, whereby further the absorption liquid stored in the absorbing container will be evaporated and condensed inside the evaporator thereby emitting heat which melts the ice deposited on the evaporator, and that the method will be carried out again in the first operating mode upon a pressure rise in the evaporator due to the disappearance of the ice depositions.

21. Method according to claim 18 wherein the predetermined threshold temperature value is 0° C.

22. A multimode method for heating one or more rooms or buildings equipped with radiators and heating fluid supply lines the first operating mode including the steps of:

evaporating a suitable operating fluid inside an evaporating means thereby taking up heat from the surrounding;

absorbing the operating fluid in an absorption liquid contained in an absorbing means;

transporting the absorption liquid together with the operating fluid to a boiling means and separating the operating fluid from the absorption liquid by application of heat;

condensing the separated operating fluid in a condensing means thereby transferring heat to the heating fluid;

and returning the operating fluid to the evaporating means;

said method further comprising a second operating mode including the step of directly feeding the operating fluid discharged from the condensing means to the boiling means bypassing the evaporating means and the absorbing means; and controlling the switching back and forth between the operating modes.

23. An improved heating system which operates in a plurality of modes comprising at least one heat pump for absorbing heat from a cold heat source and supplying heat to one or more rooms, said system including first means for providing a first operating mode employing an operating medium and an absorbing liquid for heating a separate heating medium where the system operates as an absorption heat pump provided with at least one heat source and second means for providing a second operating mode employing substantially only the operating medium to heat the heating medium, said first means including an evaporator, an absorbing container, a liquid pump, a boiling receptacle to be heated, a condenser and line means for connecting the circulating system together, a first throttle valve in the line means connecting said condenser to said evaporator, a return line connected to said boiling receptacle and said absorbing container, said absorbing container being so large that the whole supply of the absorption liquid can be stored therein, said second means including shut-off valve means for shutting off that portion of the system including said evaporator and said absorbing container from the rest of the system, and for opening a line connecting said condenser and said liquid pump so that more heat is produced.

24. A multimode heating system for heating one or more rooms comprising means for circulating a heating fluid to treat the environment in the rooms, a first operating mode employing a primary heat pump means employing an operating fluid and an absorbing liquid for absorbing heat from cold and hot heat sources and transferring such heat to the heating fluid by one or more heat exchangers, a second operating mode wherein the cold heat source is bypassed and substantially only the operating fluid is used to heat the heating fluid by being returned directly to said hot heat source and control means for controlling changes in the operation of the multimode heating system between the first and second operating modes in response to exterior temperature conditions wherein said primary heat pump means includes evaporator means for evaporating the operating fluid, absorbing means for receiving both the evaporated operating fluid and the absorbing liquid, so that the latter can absorb the former; boiler means for receiving the absorbing liquid and the absorbed operating fluid and for separating the operating fluid from the absorbing liquid, said boiler means further including conduit means for providing a connection to said absorbing means so that the absorbing liquid can return to said absorbing means following separation from the operating fluid when the system is operating in the first mode, mean for moving the absorbing liquid between said absorbing means and said boiler means; and condensing means connected to said boiler means for receiving and condensing said separated operating fluid.

25. A multimode heating system as in claim 24 wherein at least one of the heat exchangers for transferring heat from the operating fluid to the heating fluid in the first operating mode is suited to transfer heat from the operating fluid to the heating fluid in the second operating mode.

* * * * *